United States Patent [19]

Linger

[11] 4,093,327

[45] June 6, 1978

[54] HAND GRIP ASSEMBLY FOR MOVABLE CABINET

[75] Inventor: Harrison K. Linger, Louisville, Ky.

[73] Assignee: General Electric Company, Louisville, Ky.

[21] Appl. No.: 735,603

[22] Filed: Oct. 26, 1976

[51] Int. Cl.[2] ..... A47B 95/02; A47F 4/08; B65D 25/06

[52] U.S. Cl. ..... 312/244; 16/124; 220/94 A

[58] Field of Search ..... 294/27 H; 224/45 R, 224/58; 220/94 R, 94 A, DIG. 15; 190/39; 312/250, 244; 16/110–124

[56] References Cited

U.S. PATENT DOCUMENTS

| | | | |
|---|---|---|---|
| 1,283,351 | 10/1918 | Stone | 220/94 A |
| 3,098,686 | 7/1963 | Benoit | 16/124 X |
| 3,150,902 | 9/1964 | Naab et al. | 312/210 XA |
| 3,435,982 | 4/1969 | Sneed | 220/94 A |
| 3,731,839 | 5/1973 | Long | 220/94 A |
| 3,938,688 | 2/1976 | Ryan | 220/94 A |

FOREIGN PATENT DOCUMENTS

| | | | |
|---|---|---|---|
| 452,913 | 9/1936 | United Kingdom | 16/124 |

*Primary Examiner*—Paul R. Gilliam
*Assistant Examiner*—V. N. Sakran
*Attorney, Agent, or Firm*—Frederick P. Weidner; Francis H. Boos

[57] ABSTRACT

An improved hand grip assembly for a portable cabinet that includes a finger receiving portion secured to a side wall of the cabinet and located on a line diagonally across the corner of the side wall near the top and front walls of the cabinet. For more control over movement of the cabinet there may also be provided a recess area in the top wall for receiving a person's thumb. This recess area provides a gripping rail for the thumb such that the rail is located between the thumb and the rest of a person's hand. For optimum control over movement of the cabinet a finger receiving portion and recess area are provided on both sides of the cabinet.

7 Claims, 7 Drawing Figures

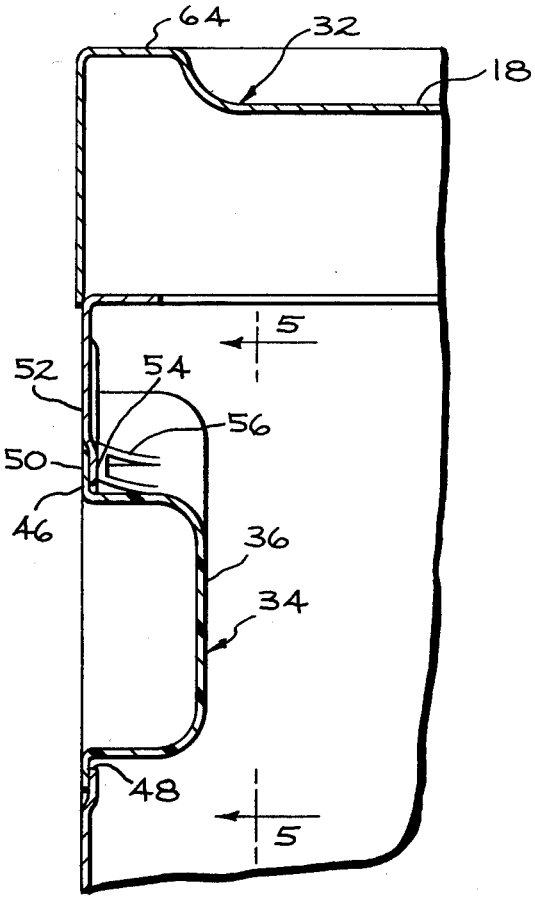
FIG.4
FIG.5
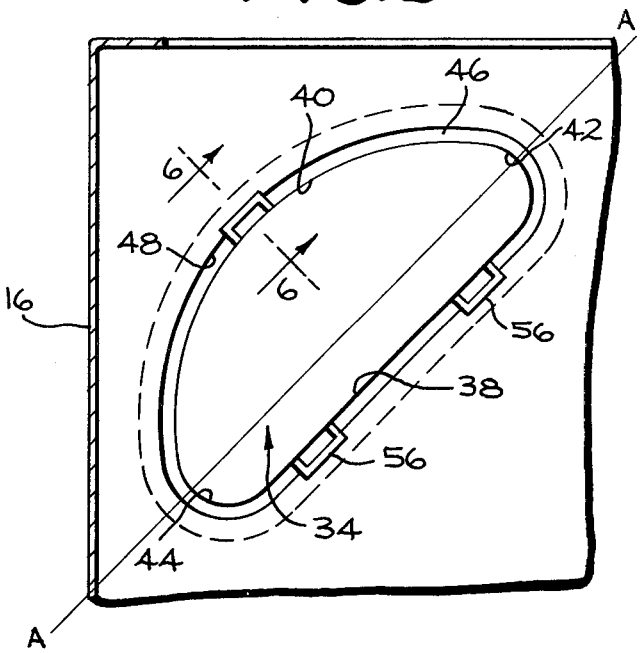
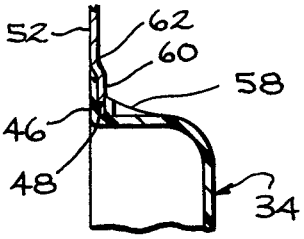
FIG.6
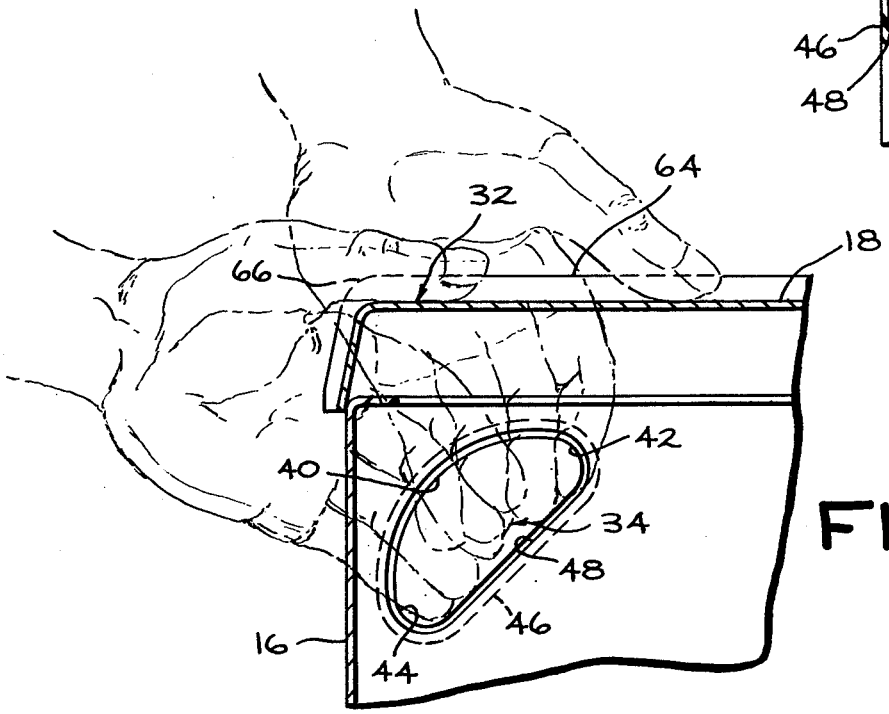
FIG.7

HAND GRIP ASSEMBLY FOR MOVABLE CABINET

BACKGROUND OF THE INVENTION

1. Field of the Invention

The present invention relates to portable or movable cabinets and in particular to an improved hand grip assembly for use in connection with movable cabinets such as automatic washing machines.

2. Description of the Prior Art

Movable appliances such as automatic washing machines and dishwashers, are provided with casters for moving the appliance from its storage place over to a household sink wherein the appliance may be hooked up to the pressurized tap water faucet for operation of the appliance. Upon completion of the operation the appliance is disconnected from the faucet and returned to its place of storage. It is highly desirable, that the movement of the appliance be made as easy as possible with a minimum of physical effort needed to accomplish the task. Movable appliances are generally square in shape and rather cumbersome to maneuver. They are fairly heavy and difficult to grip as there are no surfaces available for a person to get a good firm clasp. Moreover, in many cases it is desirable to lift the front of the appliance during its movement in order to assist it over rugs, mats, door jambs and the like. To help solve the above-mentioned problems with moving an appliance, handles have heretofore been provided on appliances. These various handle structural arrangements help, however, they do not minimize the amount of physical force and manual effort required for positive control when moving the appliance. Most prior art handles extend or protrude from the cabinet and they do not allow a person's hands to be positioned in the most natural and efficient manner as to control the combined directional, lateral, and vertical movements of the appliance.

It is therefore an object of the present invention to provide an improved hand grip assembly for movable cabinets, such as appliances, and in particular portable automatic washing machines wherein the movable cabinet is more easily manually moved from one place to another.

SUMMARY OF THE INVENTION

In accordance with the present invention there is provided a portable cabinet including a bottom, front, top, and side walls. The improved hand grip assembly comprises a finger receiving portion secured to a side wall of the cabinet and located on a line diagonally across the corner of the side wall near the top and front walls of the cabinet. For more control over movement of the cabinet there may also be a recess area in the top wall for receiving a thumb. This recess area is located inwardly of the side wall having the finger receiving portion and spaced relative to the finger receiving portion such that a hand of a person is accommodated in the respective finger receiving portion and thumb recess simultaneously. Preferably for optimum control over movement of the cabinet a finger receiving portion and recess area are provided at both sides of the cabinet.

BRIEF DESCRIPTION OF THE DRAWINGS

FIG. 4 is a front cross-sectional view showing the details of the improved hand grip assembly of the present invention.

FIG. 5 is a view taken generally along lines 5—5 of FIG. 4.

FIG. 6 is a view taken generally along lines 6—6 of FIG. 5.

FIG. 7 is a side elevational view showing the improved hand grip assembly of this invention and a person's hand in two positions to demonstrate the range of hand movement permitted as required when controlling movement of the appliance.

DESCRIPTION OF THE PREFERRED EMBODIMENT

Figure 1:
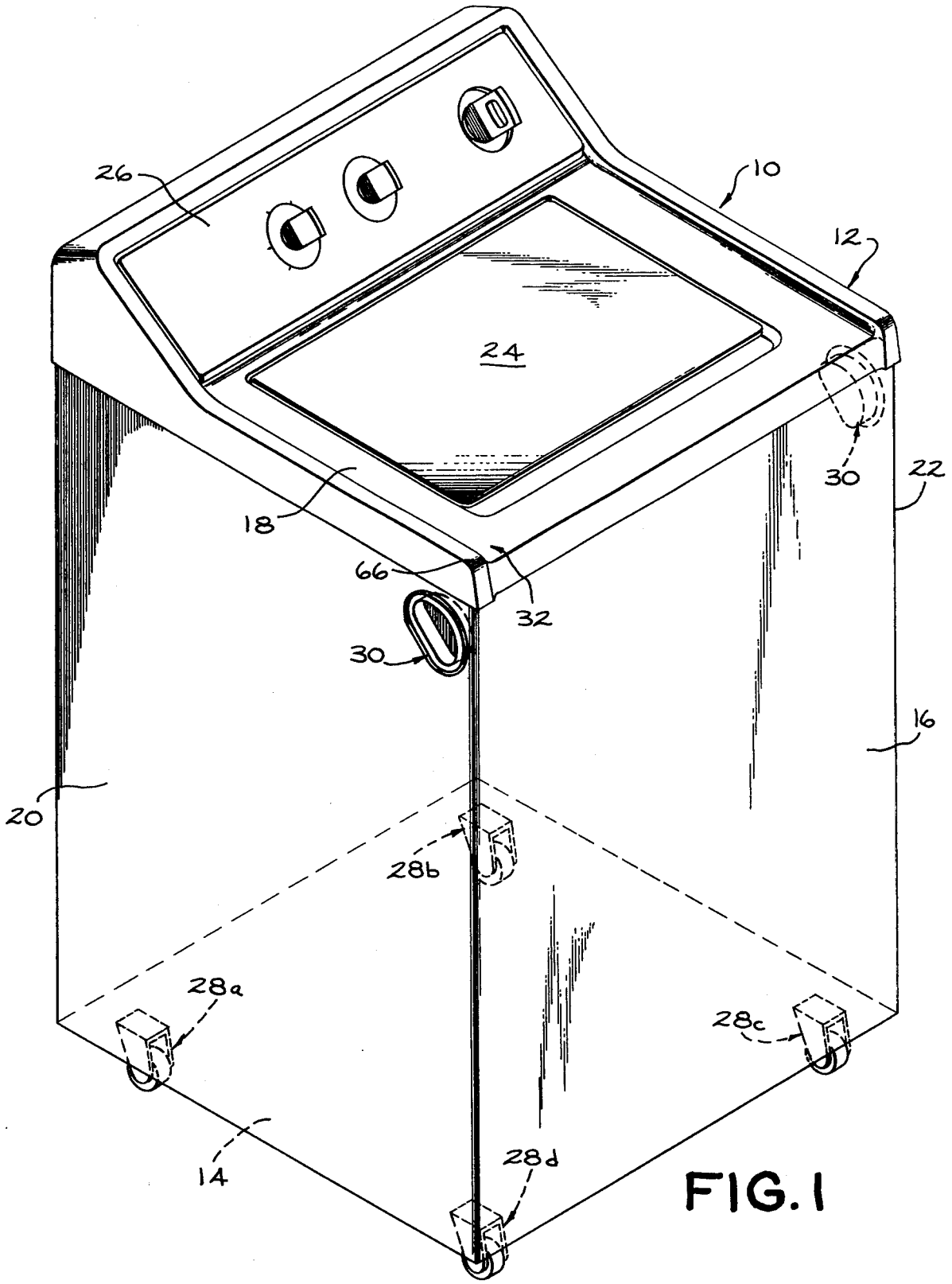
FIG. 1 is a perspective view of a movable automatic washing machine appliance incorporating the improved hand grip assembly of the present invention.

Referring to FIG. 1, there is shown a movable automatic clothes washing machine 10. The machine includes an appearance cabinet 12 which includes a bottom wall 14, a front wall 16, a top wall 18 and two side walls 20 and 22. The top wall 18 includes a cover 24 hingedly mounted thereon. The top wall 18 also has at the rear thereof a control panel 26 which houses the controls for conducting the washing machine 10 through various washing cycles which may be selected by the operator. The bottom wall 14 of the cabinet 12 has secured to it a plurality of friction reducing devices which in the case of the preferred embodiment are casters 28*a*, 28*b*, 28*c* and 28*d* located at all four corners of the bottom wall. It should be noted that some portable appliances may utilize less than four friction reducing devices such as, for example, only two such devices located at the rear corners of the machine.

In the preferred embodiment of this invention there is an improved hand grip assembly provided on both sides of the machine near the front thereof. However, since they are identical only the detailed structural arrangement of one of the hand grip assemblies will be described.

The improved hand grip assembly includes a finger receiving portion 30 and a recessed area 32 in the top wall 18 which is located inwardly of the side wall 20 and spaced relative to the finger receiving portion 30 such that a person's hand is accommodated in the finger receiving portion 30 and the recess area 32 simultaneously.

The finger receiving portion 30 is secured to the side wall 20 and located on a line diagonally across the corner of the side wall 20 near the top and front walls. This diagonal line is through the longitudinal axis of the finger receiving portion 30 as shown in FIG. 5 and designated A—A. The diagonal line intersects the front wall 16 and the top wall 18 to provide an included acute angle in both cases of approximately 45°. This angle may vary somewhat yet accomplish the desired movement control with considerable manual ease.

Finger receiving portion 30 includes a cup-shaped body 34 that has a bottom panel 36, a straight side wall 38 and a curved side wall 40 both of which depend from the bottom panel, and join each other at curved portions 42 and 44. It should be noted that the depending curved side wall 40 is curved outwardly in the direction of the front wall 16 and top wall 18 of the cabinet 12. The purpose and function of this curvature will be discussed later. The cup-shaped body 34 has an outwardly directed flange 46 forming a lip continuously around the top of the depending straight and curved side walls 38 and 40, respectively.

To accommodate the finger receiving portion 30 the side wall 20 has an opening 48 which is the same shape but slightly larger than the cup-shaped body 34 and smaller than the peripheral edge of the circumferential flange 46. In this manner the cup-shaped body 34 may be inserted into and through the opening 48 but not beyond the flange 46. Often it is desirable that the exterior surface 50 of the flange 46 be flush or in the same plane as the exterior surface 52 of the side wall 20. To accomplish this an area 54 in the side wall 20 approximately the width of the flange 48 and circumferentially around the opening 48 is detented inwardly.

To retain the finger receiving portion 30 in its proper position there is provided a plurality of retainer elements 56 on the depending side walls 38 and 40 of the cup-shaped body 34. Each of the retainer elements 56 has a sloping surface 58 that departs from the side wall from near the bottom of the cup-shaped body 34 and terminates with a retaining surface 60 that is perpendicular to the side wall. The retaining surface 60 is spaced inwardly of or below the flange 46 a distance slightly more than the thickness of the side wall 20. The finger receiving portion 30 is preferably made of resilient or flexible material such as a plastic molded body and in this manner the finger receiving portion may be inserted through the opening 48 and by urging the cup-shaped body 34 inwardly the side walls 38 and 40 are flexed by the camming action of the retainer element sloping surface 58 and when in its proper position will snap back allowing the retaining surface 60 to engage the interior surface 62 of the side wall 20 as particularly shown in FIG. 6. It is possible that instead of a separate finger receiving portion 30 the side wall 20, if made of suitable material, could be drawn or molded to provide a integral finger receiving portion 30 therein.

In the top wall 18 of the cabinet 12 there is provided a recess area 32 for receiving a person's thumb. This recess area 32 may be provided by deforming or molding the top wall 18 such that there is a gripping rail 64 provided between the recess area 32 and the side wall 20 or 22. This gripping rail has a curved area 66 between the top wall 18 and the front wall 16. While there is shown a single recess area 32 which may extend across the cabinet top wall 18, there may be, if desired, two separate recess areas located at each side of the top wall 18 of the cabinet 12.

Figure 2:
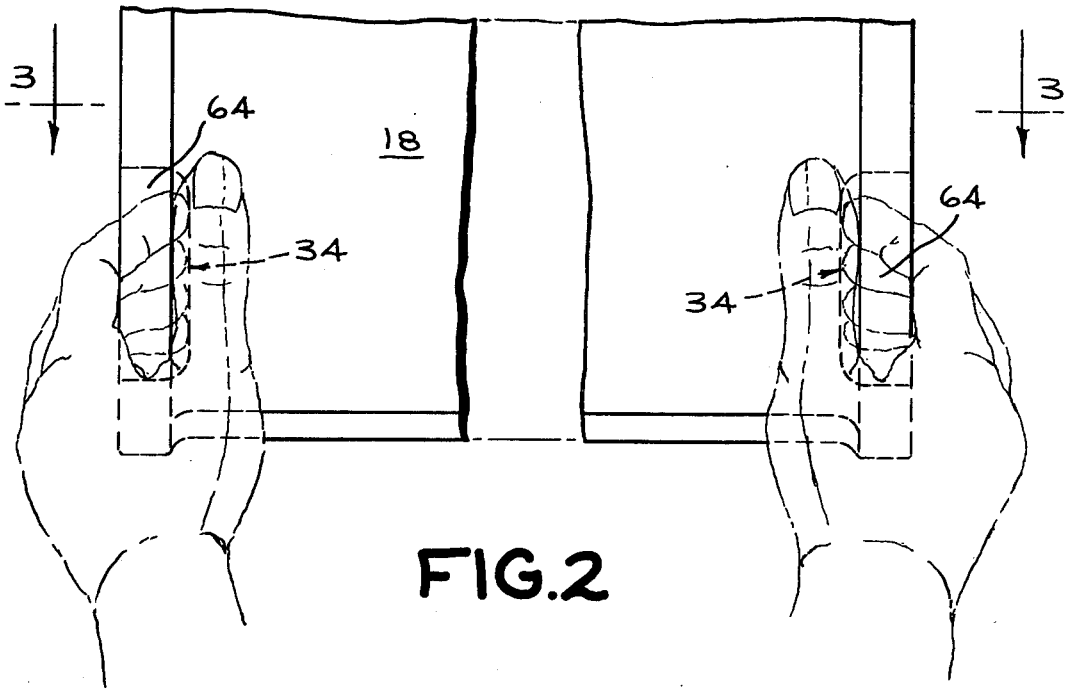
FIG. 2 is a top plan view of a portion of the movable automatic washing machine appliance of FIG. 1 showing a person's hands gripping the improved hand grip assembly of the present invention.
Figure 3:
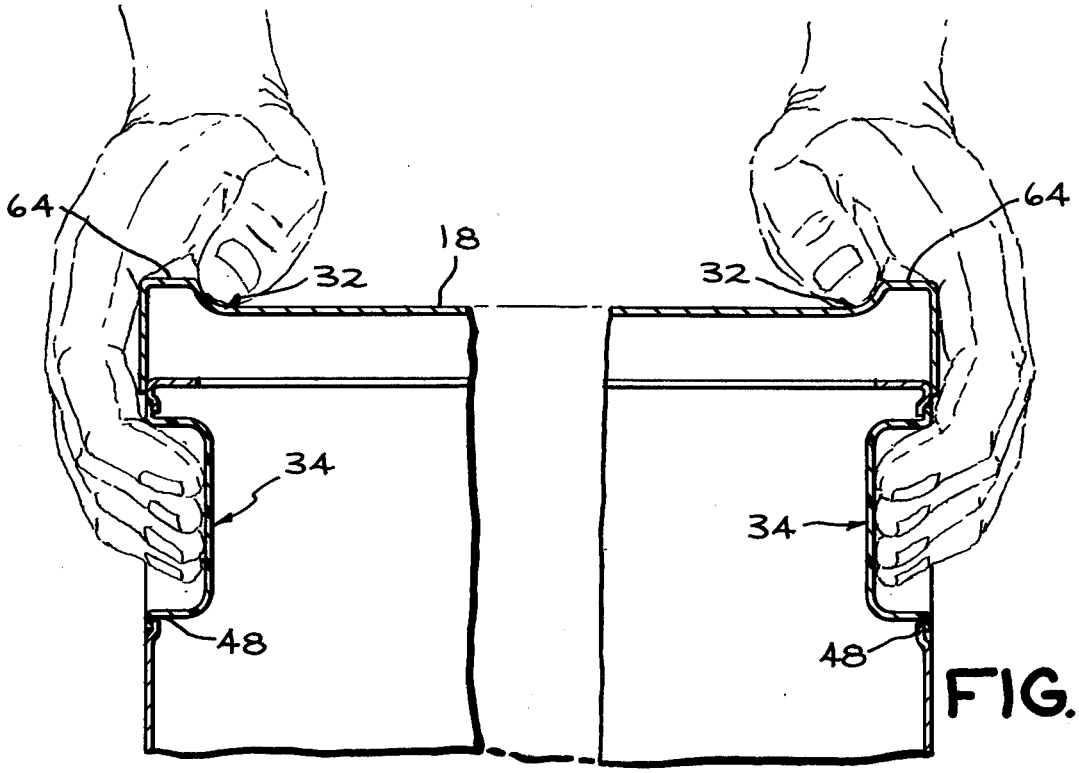
FIG. 3 is a view taken generally along lines 3—3 of FIG. 2.

FIGS. 2 and 3 show the cooperative relationship between the finger receiving portion 30 and the recess area 32 to accommodate a person's hand. It will be noted that the fingers will be received inside the cup-shaped body 34 of the finger receiving portion 30 and the thumb will be received in the recess portion 32 in the top wall 18 with the gripping rail 64 located therebetween. Thus there is a surface against which the user's thumb may be exerted. By this arrangement the hand grip assembly physically suits the natural grip of a person's hand with the palm of the hand placed along the side wall 20 and 22 of the cabinet 12 below the curved area 66 of the gripping rail 64. Thus a firm grip on the cabinet is achieved by having a recessed area for the fingers to fit into and a gripping rail 64 for the thumb to grip against.

Many times during movement of the cabinet from one location to another there is required some force either up or down in order to more easily move the cabinet over rugs, mats, door jambs, etc. For ease of movement over such obstacles the total required movement involves a combination of lateral and vertical force in order for it to more easily be directed on its course throughout an area such as the house. With particular reference to FIG. 7 there is shown two positions of the user's hand to demonstrate the range of hand movement wherein the hands are free to make adjustments to these required forces without the need to alter the basic grip or hold on the cabinet. The hand shown in the lower position would be the position normally assumed when the cabinet is being moved on a rather level flat surface. The hand shown in the upper position would be the position normally assumed when the cabinet is being raised at its front so that the casters **28*c* and 28*d* may be raised up and over an obstacle. The depending curved side wall 40 of the cup-shaped body 34 allows the fingers to be moved or rotated within the cup-shaped portion very easily depending upon the attitude of the hand and in addition the finger tips have maximum contact or purchase with the inner surface of the depending curved side wall 40. It will be noted that when the hand is in the upper position as shown in FIG. 7 the person's thumb will naturally assume a position rearward of the front wall 16** but yet the hand grip is essentially the same in either position relative to the thumb and fingers.

The flush mounting of the finger receiving portion 30 provides that it does not extend beyond the basic geometry of the cabinet and thus it is especially suited to a cabinet, such as a portable clothes washer, which typical to its use is best stored in a limited space such as a small closet or rack type enclosure.

While the preferred embodiment described above shows the use of a recess area 32 against which the thumb may grip the rail 64, it is possible to still have control of the cabinet without the recess area and gripping rail, however, the lateral control, that is, ease of moving the cabinet from side to side, is somewhat more limited. Also, while the preferred embodiment described above shows two finger receiving portions 30 on both side walls 20 and 22 to accommodate the fingers of both the right and left hand, it is physically suitable to move and direct the cabinet using only one hand grip assembly, however, in this case vertical or lifting control is more limited.

The foregoing is a description of the preferred embodiment of the invention. In accordance with the Patent Statutes, changes may be made in the disclosed apparatus and the method in which it is assembled without actually departing from the true spirit and scope of this invention as defined in the appended claims.

I claim:

1. In a portable cabinet including a bottom, front, top, and two side walls, an improved hand grip assembly comprising:

a finger receiving portion secured to each of the side walls and located on a line diagonally across the corner of each of the side walls near the top and front walls, and a recess area in the top wall for receiving a thumb, said recess area being inwardly of each of the side walls and spaced relative to each of the finger receiving portions such that both hands of a person are accommodated in the respective finger receiving portions and thumb recess simultaneously.

2. In the portable cabinet improved hand grip assembly of claim 1 wherein the finger receiving portion is recessed in each of the side walls.

3. In the portable cabinet improved hand grip assembly of claim 1 wherein the finger receiving portions have a finger-contacting surface that is curved between one end and the other, said curvature being outwardly in the direction of the front and top wall.

4. In the portable cabinet improved hand grip assembly of claim 1 wherein the recess area in the top wall for receiving the thumb extends across the cabinet top.

5. In the portable cabinet improved hand grip assembly of claim 1 wherein the area between the recess and side wall is curved between the top and front walls of the cabinet.

6. In the portable cabinet improved hand grip assembly of claim 1 wherein the bottom of the cabinet has a plurality of friction reducing devices secured thereto.

7. In the portable cabinet improved hand grip assembly of claim 6 wherein the friction reducing devices are casters.

* * * * *